US005653667A

United States Patent [19]

Reyes

[11] Patent Number: 5,653,667

[45] Date of Patent: Aug. 5, 1997

[54] EXERCISE MACHINE

[75] Inventor: Gilbert Reyes, Las Vegas, Nev.

[73] Assignee: Reyes Equipment, Inc., Las Vegas, Nev.

[21] Appl. No.: 367,087

[22] Filed: Dec. 30, 1994

[51] Int. Cl.[6] ..... A63B 21/00

[52] U.S. Cl. ..... 482/121; 482/123; 482/133

[58] Field of Search ..... 482/100, 97, 137, 482/135, 121, 122, 123, 79, 148, 142, 129, 130, 70, 71, 52

[56] References Cited

U.S. PATENT DOCUMENTS

| | | | |
|---|---|---|---|
| 935,854 | 10/1909 | Linerode | 482/129 |
| 2,356,260 | 8/1944 | Maxwell | 482/129 |
| 4,022,463 | 5/1977 | Scott, Jr. | 482/122 |
| 4,556,216 | 12/1985 | Pikanen | 482/137 |
| 4,811,946 | 3/1989 | Pelczar | 482/121 |
| 5,284,465 | 2/1994 | Homan, Jr. | 482/79 |

OTHER PUBLICATIONS

Cybex Strength Systems brochure p. 2 Seated Calf Station Dec. 1989.

*Primary Examiner*—Jerome Donnelly
*Attorney, Agent, or Firm*—Knobbe, Martens, Olson & Bear, LLP

[57] ABSTRACT

An exercise machine for use in exercising a user's calf muscles includes a frame having a ground-contacting support, first and second spaced-apart knee-engaging pads which are movable in a vertical plane, a seat, and springs resisting the upward movement of the pads. The pads are each located at the end of a lever arm which is rotatably mounted to the frame at an opposite end. The springs are mounted on slidable sleeves, allowing a user to adjust the resistive force. A handle engages each arm and is movable between a first position in which the arm is in a raised, locked position, to a second position in which the pad engages the knee of the exerciser. A user places the balls of his feet on a platform and presses the pads upwardly with his knees against the springs to exercise his calf muscles.

12 Claims, 5 Drawing Sheets

EXERCISE MACHINE

FIELD OF THE INVENTION

The present invention relates to an exercise machine, especially for exercising the calf muscles of legs.

BACKGROUND OF THE INVENTION

A user has several exercises to choose from for exercising his calf muscles (known medically as the "gastrocnemius" muscles). These muscles are located on the back of the tibia and fibula bones of the lower leg.

Some of the presently available exercises are useful in exercising the calf, but present a risk of injury to other portions of the body. In one common exercise, for example, the exerciser stands with a heavily weighted bar or similar device on his shoulders. He then places the balls of his feet on a platform, allowing the heels of his feet to overhang an open space. The user raises his body up and down against the weight by moving his heels up and down using his his calf muscles.

The most serious drawback to this exercise is that a substantial amount of weight is supported by the user's back during the exercise. Further, as the calf muscles tire, users often raise and lower the bar by slumping and straightening their backs instead of solely using their calves. Back injuries are often the result.

One exercise which does not involve directly supporting the weight on the back is where a user sits and supports a bar across his knees. With the balls of his feet resting on a platform or other flat surface, the user exercises his calf muscles by raising his legs up and down. This exercise has several other drawbacks.

First, the user must support the narrow, heavy bar on his knees, which is often quite uncomfortable. The user must also move the bar onto, and off from, his knees. When a substantial amount of weight is involved, movement of the bar from a standing position to a seated position above the exerciser's knees is unstable and risky. When removing the bar while seated, the user grasps the bar and forces his body upwardly without the aid of his lower legs. In both maneuvers, the exerciser risks back and leg injuries.

Neither exercise allow for easy adjustment of the force against which the calves are exercised. For example, in the case of the second exercise, the user must place the bar back on the ground and add or subtract weights from the bar, and then place the bar back onto his knees before continuing.

Further, neither exercise allows a user to independently adjust the force against which each calf muscle exercises. In the first exercise, the weight supported on the shoulders is evenly distributed between the two legs. The same is true of the second exercise where the bar spans both knees. In many instances, a user wishes to exercise one of the calf muscles against a slightly different force than the other, or may even wish to exercise one calf muscle but not the other.

SUMMARY OF THE INVENTION

An exercise machine for exercising the calf muscles includes a frame, first and second knee-engaging pads, a user supporting seat, and springs resisting upward movement of the knee-engaging pads.

The frame includes a ground contacting base and two vertically spaced supports. A rod extends between the tops of the supports. Two spaced lever arms, rotatably connected to the rod, extend outwardly towards the seat. The knee-engaging pads are located on the bottom of the ends of the lever arms nearest the seat, above and in front of the seat.

Three springs extend between each lever arm and the base, providing resistance to the upward movement of the pads. Each end of the spring is connected to a sleeve which is slidably located on a runner located on the arm and base.

Two handles extend upwardly from the frame. A first end of each handle includes a roller which engages the bottom of one of the arms. A second end of each handle includes a grip engageable by a user. The handles are rotatable from a first position in which each lever arm is located in a raised, locked position, to a second position in which the arms are pulled downwardly by the springs and engage the knees of a user.

In use, the exerciser locks the lever arms in their raised positions. The exerciser sits on the seat and places a knee under each of the pads. The exerciser moves the handles to their second position, lowering the pads into contact with his knees. The exerciser raises and lowers each pad against the spring force, exercising his calf muscles.

The exerciser can adjust the resistive exercise force by moving the ends of the springs along the runners and locking them into a new position. By increasing the distance between the ends of the springs, the exerciser can increase the exercise force, and by decreasing the distance between the ends of the springs, the exerciser can decrease the exercise force.

Objects, features, and advantages of the present invention over these prior art devices and exercises will become apparent from the detailed description of the drawings which follows, when considered with the attached figures.

DETAILED DESCRIPTION OF THE PREFERRED EMBODIMENT

Figure 1:
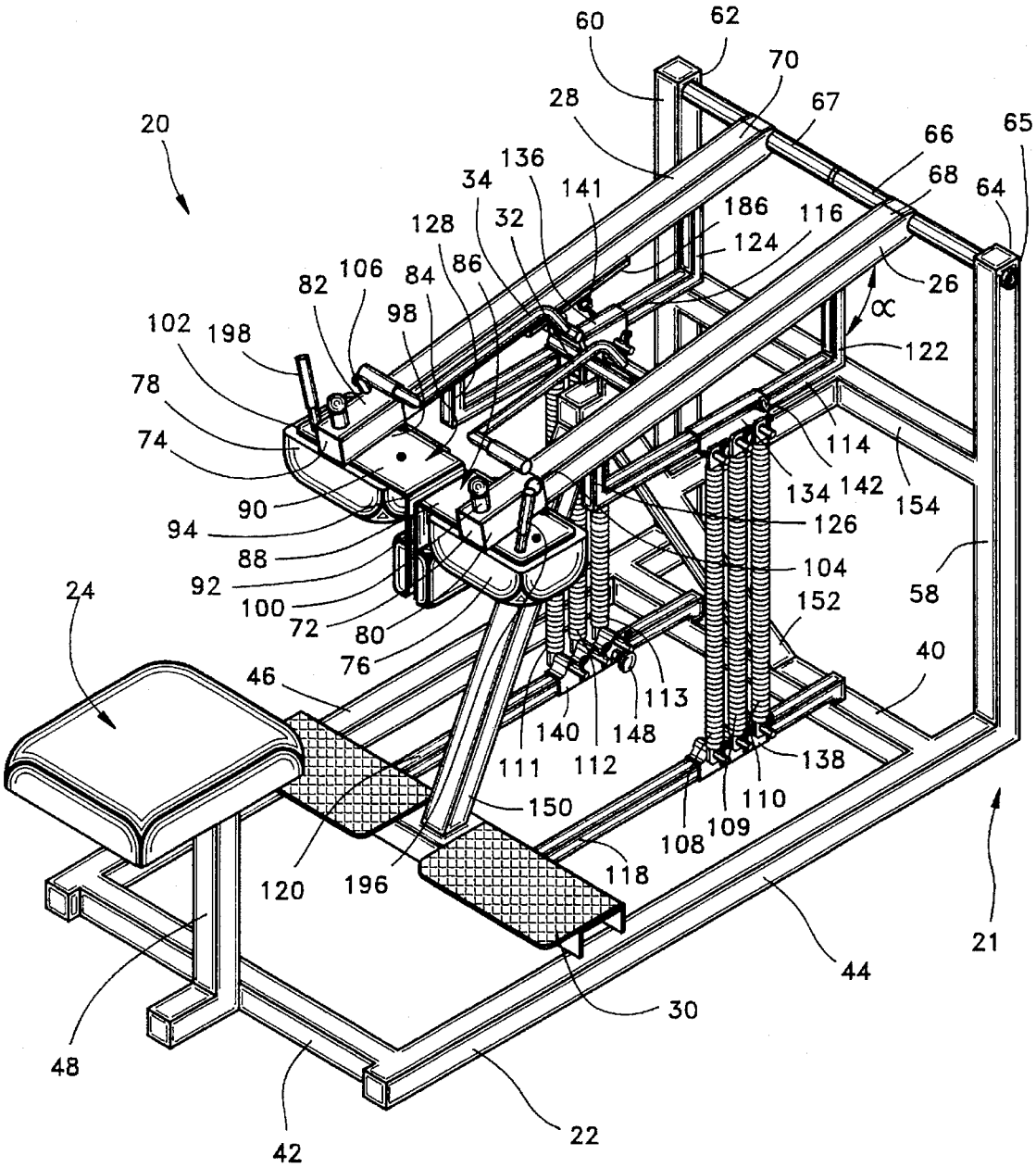
FIG. 1 is a perspective view of an exercise machine in accordance with the present invention.

FIG. 1 illustrates a calf exercising machine 20 in accordance with the present invention. In general, the machine 20 comprises a frame 21 including a ground-contacting base 22, user-supporting seat 24 located above the base, two leg-engaging pads 76,78, a foot-supporting platform 30, and biasing means including a plurality of tension springs opposing upward movement of each lever arm by the leg of an exerciser.

The exerciser sits on the seat 24 which extends upwardly from the base 22. The user places the balls of his feet on the platform 30, one knee under each end of the pads 76,78. Each pad 76,78 is connected by reciprocating means in the form of a rotatable lever arm 26,28, to the frame 20.

The biasing means preferably comprises a number of springs 108–113 connected between the lever arms 26,28 and the frame 21. The user exercises his calves by raising and lowering the pads 76,78 against the springs.

As additional features of the present invention, means for selectively moving the pads 76,78 and locking them in a raised position or in a lower, knee-engaging position are provided. As described in more detail below, this means comprises handles 32,34 which engage each of the lever arms 26,28 on which the pads 76,78 are mounted.

Further, means for adjusting the force exerted by the biasing means are provided. The springs 108–113 are connected to sliding sleeves 134,136,138,140 at each end, such that a user can change the distance between the ends of the springs and increase or decrease their resistance.

Figure 2:
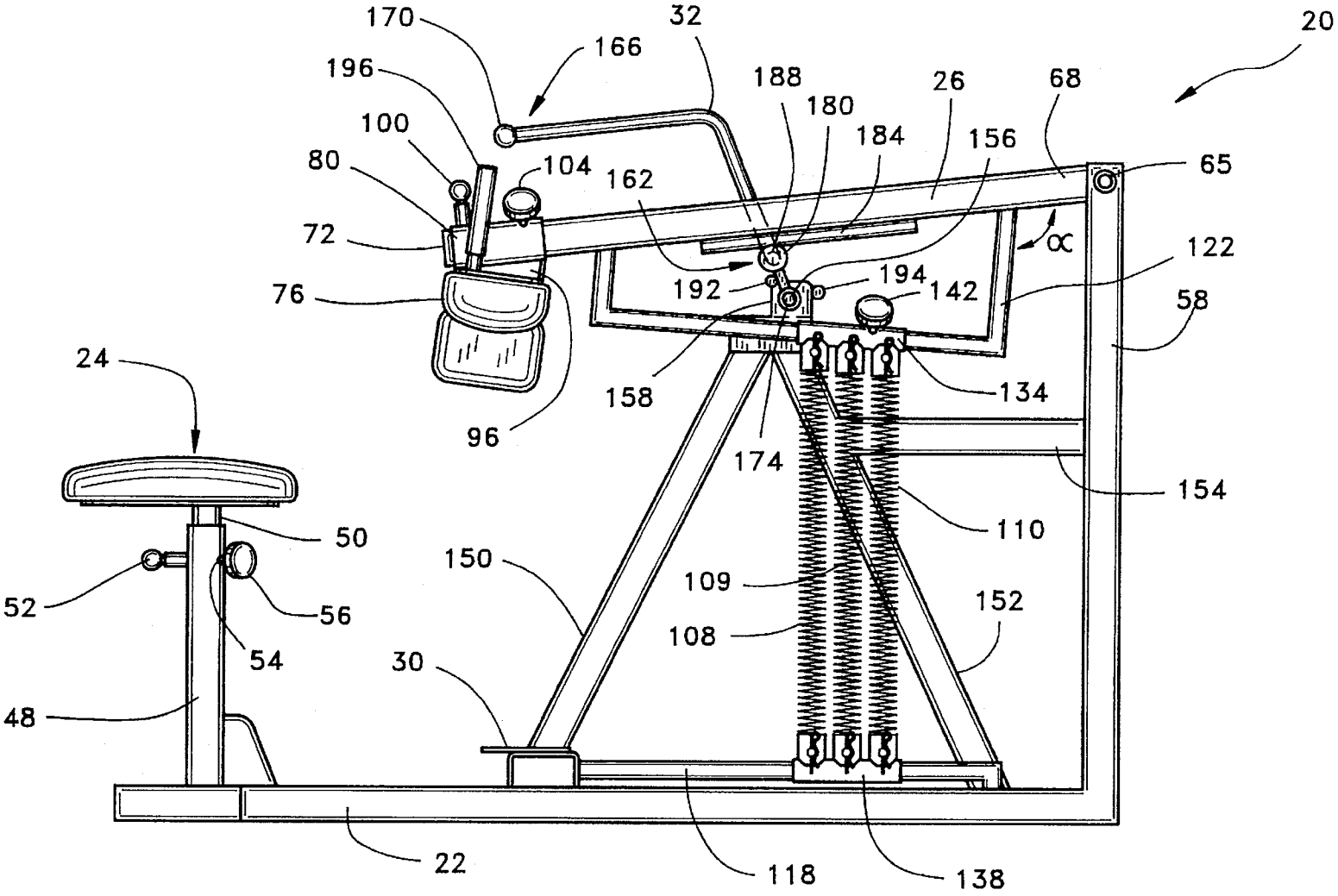
FIG. 2 is a side view of the exercise machine of FIG. 1, illustrating a lever arm thereof in a locked position.
Figure 3:
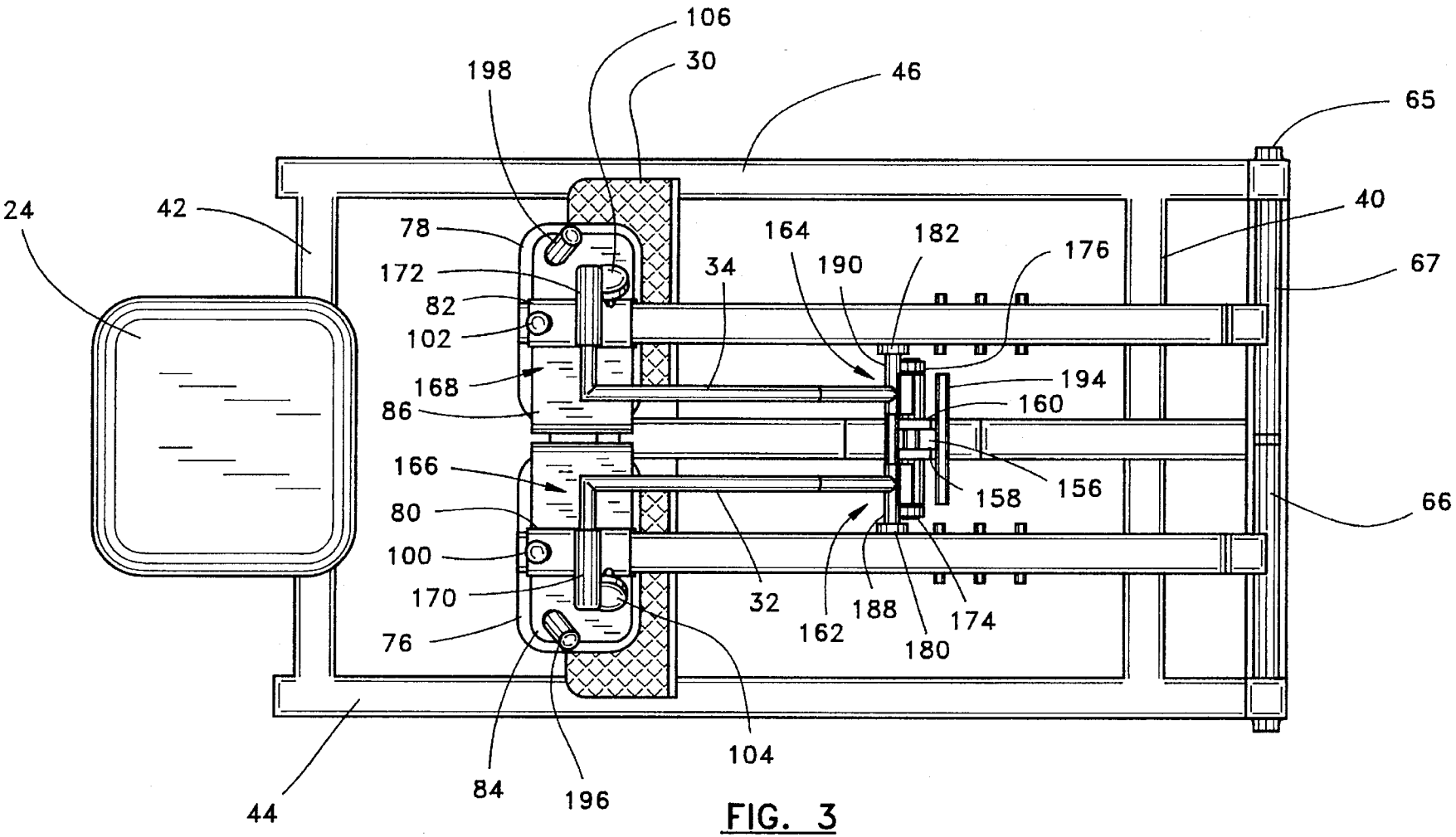
FIG. 3 is a top view of the exercise machine of FIG. 1.

Referring now to FIGS. 1–3, the present invention is described in more detail. The base 22 comprises a generally rectangular member having a first or front end 40, second or rear end 42, a first side 44, and a second side 46. The base 22 is preferably made of rigid metal tubing about 2 inches square, with a wall thickness of about 0.125 inches. The ends 40,42 are about 24 inches long, and the sides are about 46 inches long. As illustrated, the front and rear ends 40,42 are inset from the ends of the sides by about 4 inches and 1 inch, respectively. The members which comprise the base 22 are preferably welded to one another, although other attachment means such as bolts, screws and the like may be used.

The seat 24 rests on a post 48 which extends upwardly from the rear end 42 of the base 22, midway between the two sides 44,46. The post 48 is about 14 inches tall, and is constructed of metal tubing about 2 inches square. The seat 24 comprises a rigid platform such as steel or wood, and is covered by a pad of vinyl-covered foam. The seat 24 is preferably about 12–13 inches square.

Adjustment means for varying the height of the seat 24 are provided. As best illustrated in FIG. 2, a seat stem 50 extends downwardly from the platform of the seat into a post 48 extending upwardly from the rear end 42 of the base 22. The seat stem 50 has a slightly smaller outer dimension than the inner dimension of the post 48. The seat stem 50 is securely attached to the seat 24, but is moveable with respect to the post 48.

The seat 24 can be raised or lowered with respect to the base 22 by engaging a pin 52 which passes through the post 48 with one of several holes (not shown) located in the seat stem 50. The pin 52 is preferably biased inwardly towards the seat stem 50, as well known to those skilled in the art.

A threaded bolt 54 having a handle 56 thereon also passes through the post 48 for engagement with the seat stem 50. When screwed inwardly, the bolt 54 securely retains the stem 50 within the post 48, eliminating any play resulting from the difference in size between the pin 52 and hole in the stem 50.

Referring again to FIG. 1, the frame 21 also includes two parallel, vertically extending supports 58,60 rising upwardly from the front end of the sides 44,46 of the base 22. Each support 58,60 is about 40 inches tall, and is made of tubular metal about 2 inches square. Each support 58,60 is welded or attached by other means at one end to the base 22.

A rod 65 having two sleeves 66,67 thereon extends between the free ends 62,64 of the supports 58,60. The rod 65 is solid metal, preferably about 1 inch in diameter and is welded at each end to an inside surface of the support 58,60. The sleeves 66,67 are each about half the length of the rod 65, and are made of tubular metal about 1 inch in diameter and 9–10 inches long. The sleeves 66,67 have an inner diameter slightly larger than the outer diameter of the rod 65, and so are freely rotatable thereon.

Each lever arm 26,28 has a first end 68,70 connected to a respective sleeve 66,67, and a second end 72,74 located near the seat 24. The lever arms 26,28 are about 38 inches long, and constructed of metal tubing 2 inches square. The first end 68,70 of each lever arm 26,28 is welded to its respective sleeve 66,67 the first lever arm 26 located about 3.5 inches from the first support 58, the second lever arm 28 located about 3.5 from the second support 60 (leaving a gap between the lever arms 26,28 of about 9–10 inches).

As illustrated, each lever arm 26,28 slopes downwardly from the first end 68,70 to the second end 72,74. The slope of the lever arm 26,28 is preferably about 10 to 20 degrees from a horizontal line passing through the first end 68,70 of each arm. The slope of each lever arm 26,28 is governed by their connection to the springs and handles 32,34, as described in more detail below.

A knee-engaging pad 76,78 is located on the second end 72,74 of each lever arm. Each pad 76,78 is located on an "L"-shaped support plate 86,84 connected to a sleeve 80,82 on the lever arm 26,28. The sleeve 80,82 is a square, tubular member having an inner diameter slightly greater than the outer diameter of the lever arm 26,28 for location thereon. The pads 76,78 are located above and in front of the seat 24.

The "L"-shaped support plate 84,86 comprises a first flat portion 88,90 which extends in a generally horizontal plane below the sleeve 80,82, and a downwardly depending side portion 92,94. The first flat portion 88,90 is about 9–10 inches long and 4 inches wide. A rear end of the first portion 88,90 is directly connected to the sleeve 80,82, while the front end of the first portion 88,90 depends below the sleeve 80,82 (and thus the lever arm 26,28) about 1–2 inches. A small extension 96,98 (see FIGS. 1 and 2) connects the sleeve 80,82 and the first portion 88,90 of the plate 84,86.

The second portion 92,94 of each plate 84,86 extends downwardly perpendicular to the first portion 88,90 on the inward side of the first portion 88,90. The second portion 92,94 is about 7 inches long and 4 inches wide.

The sides of the plate 84,86 which face outwardly and downwardly (towards a user's knee) are covered by a pad of vinyl covered foam for engaging the upper knee portion of a user's leg.

Adjustment means are provided for positioning the leg-engaging pads along the length of the lever arms 26,28. These adjustment means preferably comprises an inwardly biased pin 100,102 located on the sleeve 80,82 for engagement with one or more holes (not shown) in the lever arm 26,28. Further, a threaded bolt 104,106 passes through each sleeve 80,82 for engagement with the lever arm 26,28. The threaded bolt 104,106 engages the lever arm 26,28 to eliminate any play or movement between the sleeve 80,82 and lever arm caused by the difference in size between the pin 100,102 and somewhat larger hole which it engages.

A user-engaging handle 196,198 is located on each of the plates 84,86 which support the pads 76,78. The handles 196,198 extend upwardly and outwardly from the first portion 88,90 of the plate. The handles 196,198 are each about 6–7 inches tall, and comprise metal tube about 1 inch in diameter. Foam, rubber or other gripping material is preferably located on the end of the handle 196,198.

The foot-supporting platform 30 has the shape of an inverted "U" and spans the sides 44,46 of the base 22 about 13 inches from the first end 40 thereof. The platform 30 is about 3 inches high (vertical distance), and 4–6 inches deep (in the direction of front to rear of the base) and is preferably made of metal.

Biasing means oppose upward movement of each lever arm 26,28. As shown, these means comprise six springs 108–113. Three springs 108–110 extend between a top runner 114 located on one lever arm 26 and a bottom runner 118 connected to the base 22. Three springs 111–113 extend between a top runner 116 located on the other arm 28 and a bottom runner 120 connected to the base.

The top runners 114,116 extend between a first leg 122, 124 and a second leg 126,128 which depend from each arm 26,28. The first leg 122,124 extends downwardly from the lever arm 26,28 at an angle α with respect thereto of about 100 to 110 degrees (see FIG. 2). The leg 122,124 is about 10 inches long.

The second leg 126,128 extends downwardly from the lever arm 26,28 by the same angle as the first leg, and is about 4 inches long. The second leg 126,128 is connected to the lever arm 26,28 about 26–27 inches from the sleeve 66,67. The first leg 122,124 is connected to the lever arm 26,28 about 4 inches from the sleeve 66,67, such that the runner 114,116 is about 20–21 inches long.

The bottom runners 118,120 extend between the front end 42 of the base 22 and the foot-supporting platform 30 extending between the two sides 44,46 of the base 22.

The runners 118,120 comprise metal tubes about 1 inch square and 20–21 inches long. One of the runners 118 is located inwardly about 4–5 inches from the first side 44 (directly below the lever arm 26), and the other runner 120 is located inwardly about 4–5 inches from the second side 46 (directly below the other lever arm 28).

Each spring 108–113 is connected at one end to a sleeve 134,136 slidably mounted on the top runners 114,116, and at the other end to a sleeve 138,140 slidably mounted on the bottom runners 118,120. Each sleeve 134,136,138,140 is a square tubular member having an inner dimension slightly larger than the outer dimension of the runner on which it is located. The sleeves 134,136,138,140 are each about 7–8 inches long.

Rods pass through each end of the springs 108–113 into bores located in the sleeves 134,136,138,140. Pins prevent the rods from being dislodged from the springs 108–113.

As illustrated, each spring 108–113 is a coil tension spring, having an outer dimension of about 1.5–2 inches and being about 20 inches in length when unextended. The spring is preferably a CSC brand spring, model 5W20.

Because of the larger dimension of the sleeves 134,136, 138,140 with respect to the corresponding runner 114,116, 118,120, the sleeves can move along the runners. In order that the sleeves 134,136,138,140 be locked in a fixed position, threaded bolts 142,144,146,148 (bolt 146 is located across from bolt 148, but not visible in the figures) are located on each sleeve and pass therethrough for engagement with the respective runner 114,116,118,120.

Means for supporting the lever arms 26,28 above a user's leg are shown in FIGS. 1–3. The means comprises a handle 32,34 engageable with a bottom portion of each lever arm 26,28.

Each handle 32,34 is rotatably located about the top of an inverted "V"-shaped frame. A first leg 150 of the "V"-shaped frame extends upwardly from the foot-supporting platform 30, and a second leg 152 extends upwardly from the front end 40 of the base 22, the two legs meeting about 25 inches above the base. The legs 150,152, comprising 2 inch square tubular metal, are positioned between the lever arms 26,28. The legs 150,152 are about 24–28 inches long, and extend upwardly at an angle of about 60 to 65 degrees with respect to the horizontal. The legs 150,152 meet a short platform 153 (see FIG. 2) about 25 inches vertically above the base 22.

Referring now to FIGS. 2 and 3, a rod 156 passes through two upwardly extending tabs 158,160 located on the legs 150,152. The tabs 158,160 are about 2 inches long, .5 inches thick, and 2 inches high.

The rod 156 is about 8 inches long, and extends through the tabs 158,160 in a direction perpendicular to the lever arms 26,28. The rod 156 is preferably made of 1 inch diameter metal.

A first end 162,164 of each handle 32,34 is rotatably connected to the rod 156, and a free end 166,168 includes a grip 170,172. The first end 162,164 comprises a tubular member located over the portion of the rod 156 which extends beyond the tabs 158,160. A ring 174,176 located at each end of the rod 156 and prevents the handle 32,34 from sliding off of the rod.

The handle 32,34 extends upwardly about 12 inches, then bends at approximately a ninety-degree angle, extending towards the seat 24 about 12 inches. The grip 170,172 is located at the second end 166,168 of the handle 32,34 and extends outwardly perpendicular to the lever arms 26,28. The grips 170,172 are about 7 inches long and include foam padding or other gripable material on their outside surface.

A lever arm-engaging roller 180,182 is located on each handle 32,34 adjacent to its connection to the rod 156. The roller 180,182 is about 2 inches in diameter and includes a central groove or track for engagement with a rib 184,186 located on the bottom of each lever arms 26,28.

The rib 184,186 is about 11 inches long and is approximately centered between the first and second legs of the top runners 114,116. The rib 184,186 is circular in shape, having an outer diameter of about 1 inch.

Each roller 180,182 is rotatably mounted on an axle which extends from a sleeve 188,190 locatedon the handle 32,34 about 2 inches above the rod 156. In order to strengthen the area between the roller and rod 156, this section of the first end 162,164 of the handles is made of flat, wide metal plate about 0.5 inches thick.

A rear stop 192 extends across the tops of the tabs 158,160. The stop 192 is a metal rod about 0.75 inches in diameter and 5–6 inches long for engagement with the wide flat plate portion of the first end 162,164 of the handle 32,34.

A front stop 194 extends across the tabs 158,160 on their backside towards the second leg 152. The stop 194 is about 5–6 inches long and 0.75 inches in diameter.

As described in more detail below, each handle 32,34 is moveable between a first position in which it rests against the rear stop 192 and supports the lever arm 26,28 in a raised position, to a second position in which the handles 32,34 engage the front stop 194 and the springs 108–113 pull the lever arms 26,28 downwardly against the knees of a user.

The frame 21 also includes a "T"-shaped support member 154 extending between the vertical supports 58,60 and the second leg 152 of the inverted "V"-shaped member. This member 154, which is also made of 2 inch square tubular metal, provides added support to the machine 20. The member 154 is located about 19–20 inches along the supports 58,60 from the base 22, and extends over to the second leg 152.

Figure 4:
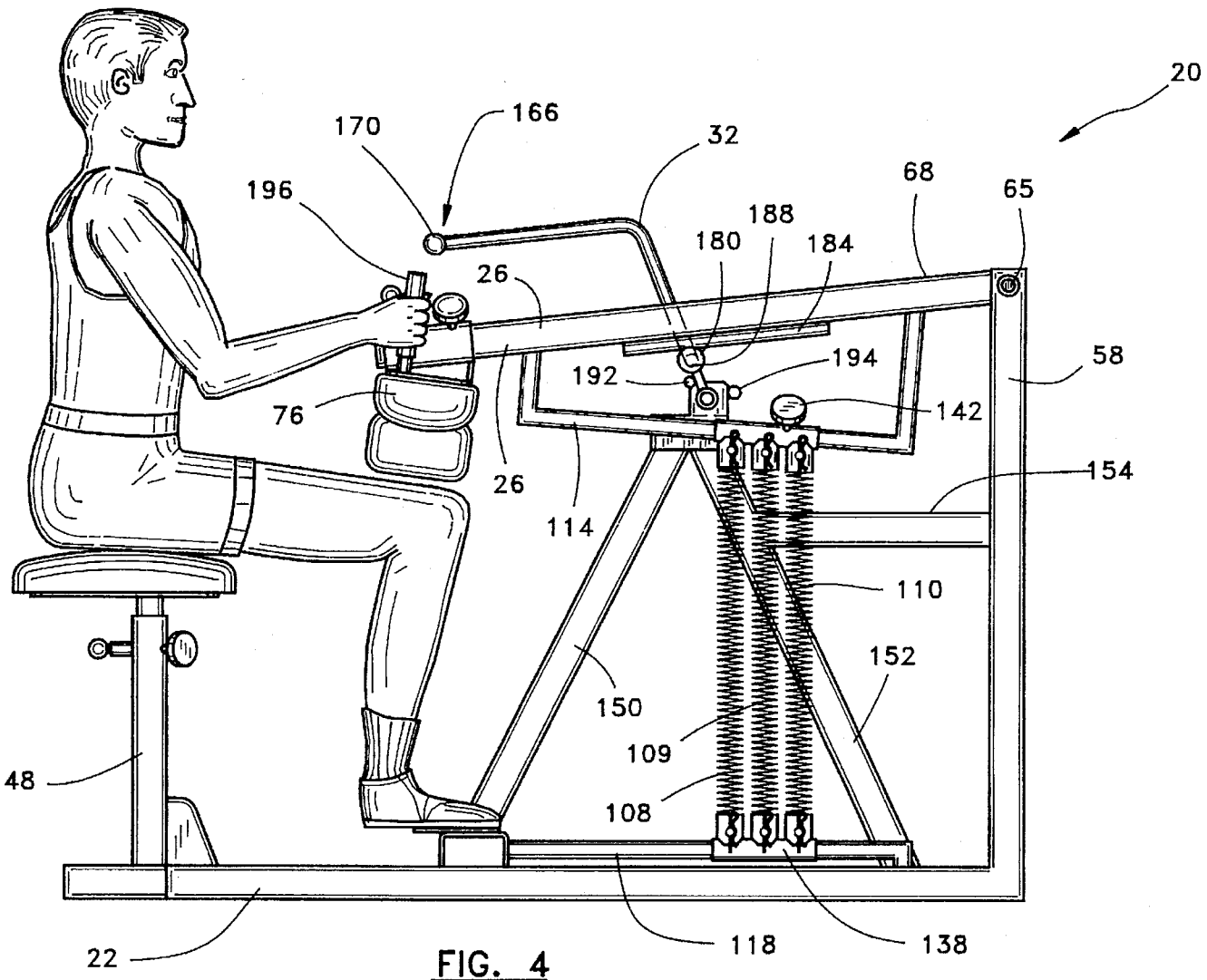
FIG. 4 is a side view of the exercise machine of FIG. 1, illustrating an exerciser seated on a seat and a knee-engaging pad located above the exerciser's leg.
Figure 5:
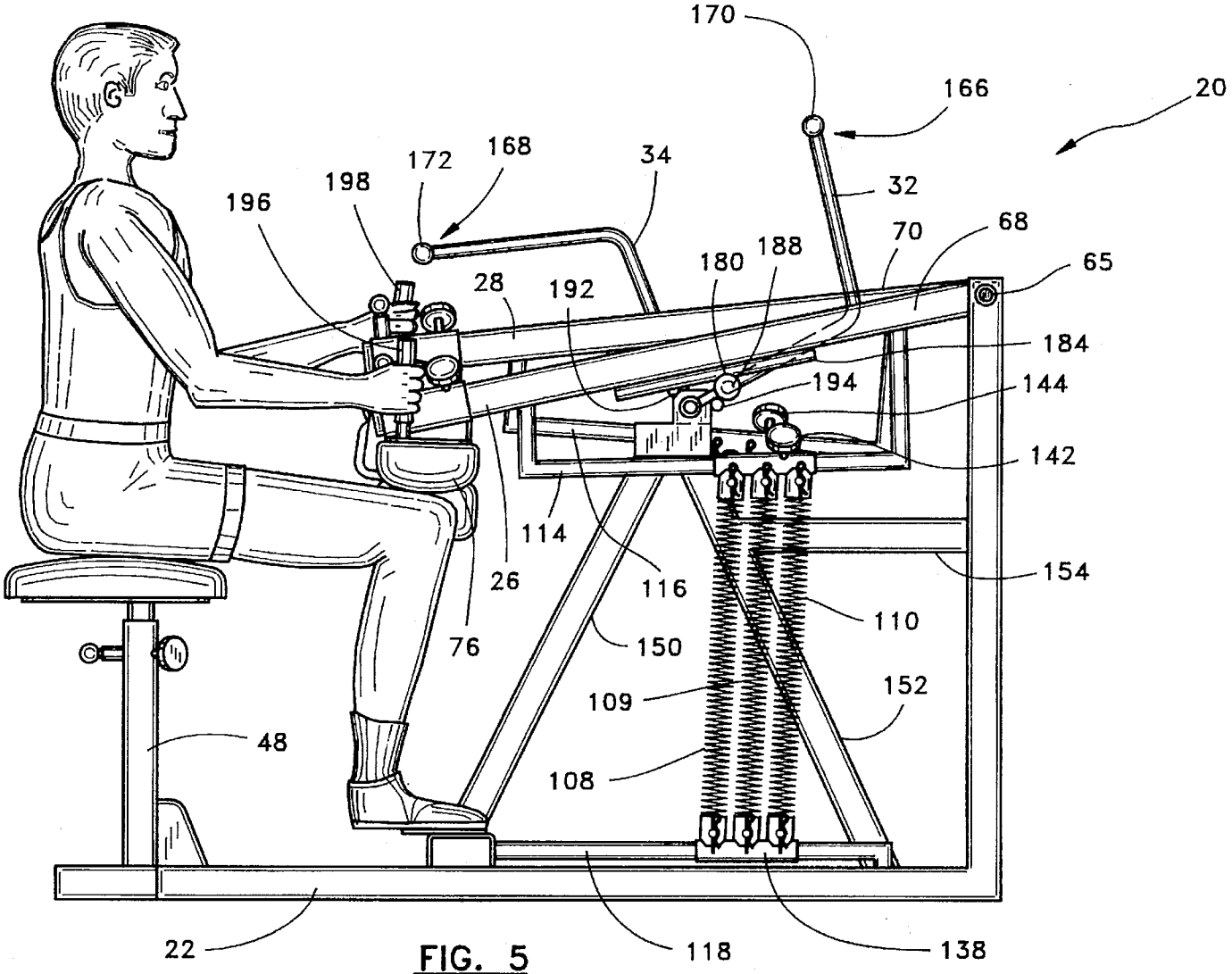
FIG. 5 is a side view of the exercise machine of FIG. 1, illustrating a pad on one of the two lever arms thereof shown engaging the knee of a user.

Use of the machine 20 of the present invention is described in conjunction with FIGS. 4 and 5.

Before sitting on the seat 24, the user ensures that each lever arm 26,28 is in an upward locked or retracted position. In this position, as illustrated in FIG. 4, each handle 32,34 extends towards the user. At the same time, the first end 162,164 of each handle 32,34 extends nearly vertically upwardly from the rod 156 pressing the lever arms 26,28 upwardly with respect to the base 22.

With both handles 32,34 in this locked position, the user sits on the seat 24 with his legs extending under the lever arms 26,28 (see FIG. 4). More particularly, the user positions one each of his knees under the pads 76,78. The term "knee" as used herein refers to that portion of the upper leg located near the knee joint.

The user positions his feet such that the balls of the feet are located on the platform 30 and the heels of his feet extend over an open space just behind the platform. At this time, the pads 76,78 are located slightly above each knee, without touching. If either pad 76,78 touches a knee, the exerciser lowers the seat 24 so that his leg fits between the platform and pad.

Once seated, the user pushes each handle 32,34 forwardly by pressing on the grips 170,172 until the handles 32,34 engage the front stop 194, a position illustrated in FIG. 5.

As each handle 32,34 moves rearwardly, the rollers 180, 182 travel rearwardly on the rib 184,186. Rotation of the handle 32,34 reduces the vertical height between the roller 180,182 and the lever arms 26,28. At the same time, the springs 108–113 pull the lever arms 26,28 downwardly to a user engaging position. Once the handles 32,34 are fully rotated, the pads 76,78 rest on the user's knees, the knees supporting the lever arms 26,28 against the force of the springs 108–113.

The user then begins the exercise. The user lifts the legs simultaneously, or alternately, against the spring force. The user moves the heels of his feet up and down using his calf muscles. Upward movement of the heels cause upward movement of the legs against the lever arms 26,28 as opposed by the springs 108–113. Then, the user releases his calf muscles and brings the heels down, flattening out the foot. This exercise is repeated numerous times.

As a further aspect of the present invention, the exerciser can adjust the force against which he works his calves. Movement of the sleeves 134,136 to which the springs 108–113 are connected with respect to the runners 114,116 changes the distance between the first and second ends of the springs, increasing or decreasing the spring tension in the rest position of the lever arms.

For example, if the sleeves 134,136,138,140 are centered on their respective runners 114,116,118,120, then the springs 108–113 have a minimum distance between their ends. In this configuration, the exerciser exercises against the smallest force available.

The user moves the sleeves 134,136 rearwardly on the top set of runners 114,116, then the distance between the ends of the springs increases, concomitantly increasing the spring tension in the rest position. As the opposing force generated by a spring is not constant, the increased distance causes the user to exercise against a greater resistive force.

As illustrated, selective adjustment of the opposing exercise force is easily accomplished by loosening the bolts 142,144 on the sleeves 134,136 and moving them with respect to the runners 114,116. The bolts 142,144 are then tightened to lock the sleeves in position.

The opposing biasing force may also be adjusted by moving the sleeves 138,140 on the bottom runners 118,120 in a similar manner. These sleeves are less accessible, however. In fact, a user can easily move the top sleeves 134,136 while remaining seated on the machine 20.

Once the exerciser has completed exercising, he reaches out, grasps the grips 170,172 and pulls them rearwardly. The rollers 180,182 force the lever arms 26,28 up off of the user's knees, and he exits the machine 20. Further, should the exerciser become fatigued or pull a muscle or the like, he can easily and quickly remove the pads from his legs.

Advantageously, a user may exercise one or both legs with the machine 20 of the present invention. In particular, simply by engaging only one or the other of the lever arms 26,28 with the leg, the user can exercise only that leg.

Further, the exerciser can independently selectively adjust the resistive exercise force on each leg, such that the legs are exercised against different resistances. Moreover, when graduated scales or the like on the runners, a user can be given a visual indication of the pounds-force against which he is exercising when the springs are located in given locations.

While the preferred biasing means are the six springs 108–113 described above, numerous other means are contemplated. For example, the biasing means can comprise only one spring connected to each arm, or more than three springs. Alternatively, the springs may be replaced with one or more hydraulic or air cylinders or pistons. Further, compression or leaf-type springs may be used, or in addition to, the tension springs. Weights may either be connected directly or indirectly to the arms, or large stretchable rubber or other elastic elements may be used. In any case, the biasing means can comprise any known method of opposing the upward movement of the arms.

Similarly, the means for adjusting the resistive exercise force can comprise a resistance selection on a hydraulic piston, runners mounted on vertically adjustable sleeves, or similar means known to those skilled in the art.

While it is preferred that the pads be located on the end of a rotatably mounted lever arm, the pads may be located on nearly any structure which allows them to move a generally vertical plane in response to the movement of an exerciser's knee. For example, the pads may each be connected to a vertically extendable post, or be mounted on a vertically moveable pin passing through a top support.

The frame described above includes a ground-contacting base. The base may be eliminated in its entirely. For example, the lever arms may be rotatably connected to a cross-member on a wall, and the seat can comprises a normal separate chair or the like for location under the arms.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. An exercise apparatus comprising:

a frame;

a user-supporting seat connected to said frame;

a first knee-engaging pad and a second knee-engaging pad mounted on said frame above and forward of the seat such that when a user sits on the seat, the pads are located immediately above the user's knees, said pads moveable in a generally vertical plane with respect to said seat, said first knee-engaging pad mounted on an end of a first lever arm, and said second knee-engaging pad mounted on an end of a second lever arm; and biasing means for resisting the upward movement of the knee-engaging pads, said biasing means comprising a spring connecting said first lever arm with said frame and a spring connecting said second lever arm with said frame.

2. The apparatus of claim 1, further including means for adjusting comprising a sleeve located at one end of said spring, said sleeve movably connected to a runner located on a base of said frame.

3. The apparatus of claim 1, further including means for adjusting said spring comprising a sleeve located at each end of each spring, said sleeves movably connected to runners on said arms and a base of said frame.

4. An exercise apparatus comprising:

a frame;

a user-supporting seat connected to said frame;

a first knee-engaging pad and a second knee-engaging pad mounted on said frame above and forward of the seat such that when a user sits on the seat, the pads are located immediately above the user's knees, said pads moveable in a generally vertical plane with respect to said seat, said first knee-engaging pad mounted on a first lever arm and said second knee-engaging pad mounted on a second lever arm; and biasing means for resisting the upward movement of the knee-engaging pads, and further including means for locking said pads in a raised position, wherein said means for locking comprises a handle moveable between first and second positions, and wherein a handle engages each arm, said handle movable between a first position in which said arm is located in a raised and locked position, to a second position in which said arm is lowered into a user engaging, movable position.

5. An exercise apparatus comprising:

a frame including a ground contacting base;

a first lever arm rotatably connected at a first end thereof to said frame, said first arm having a knee-engaging pad mounted at a second end thereof, said first lever arm rotatable in a generally vertical plane and fixed against lateral movement;

a second lever arm rotatably connected at a first end thereof to said frame, said second arm having a knee-engaging pad mounted at second end thereof, said second lever arm rotatably in a generally vertical plane and fixed against lateral movement, said first and second lever arms rotatably independent of one another; and biasing means for opposing upward movement of each arm, said biasing means comprising at least one spring connecting each arm with said base.

6. The apparatus of claim 5, wherein three springs connect said first arm and said base and three springs connect said second arm and said base.

7. The apparatus of claim 5, further including means for adjusting the resistive force generated by said springs.

8. The apparatus of claim 7, wherein said means for adjusting comprises a moveable sleeve located on at least one end of each spring.

9. The apparatus of claim 5, wherein said spring(s) are connected to a sleeve movably connected to a rod extending between two upright supports extending from said arm.

10. The apparatus of claim 5, further including means for locking said arms into a raised position.

11. The apparatus of claim 10, wherein said means for locking comprises a handle engaging each arm, said handle moveable between a first position in which said arm is located in raised and locked position, to a second position in which said arm is located in a user-engaging moveable position.

12. An exercise apparatus comprising:

a frame;

a seat;

a first arm having a first end and a second end, said first end rotatably connected to said frame;

a second arm having a first end and second end, said first end rotatably connected to said frame, said first and second arms independently rotatable with respect to one another and said frame;

a first knee-engaging pad mounted on said second end of said first arm, said pad positioned above and forward of the seat such that when a user sits on the seat, the pad is located immediately above one of a user's knees, said pad moveable in a generally vertical plane;

a second knee-engaging pad mounted on said second end of said second arm, said pad positioned above and forward of the seat such that when a user sits on the seat, the pad is located immediately above one of said user's knees, said pad moveable in a generally vertical plane;

means for retaining said first and second knee-engaging pads in a raised, locked position; and biasing means for resisting the upward movement of the knee-engaging pad.

* * * * *

UNITED STATES PATENT AND TRADEMARK OFFICE

CERTIFICATE OF CORRECTION

PATENT NO. : 5,653,667

DATED : August 5, 1997

INVENTOR(S) : Gilbert Reyes

It is certified that error appears in the above-identified patent and that said Letters Patent is hereby corrected as shown below:

Column 1, Line 21, delete the second occurence of --his--.
Column 6, Line 3, delete the second occurrence of --,-- appearing after the word "long".
Column 6, Line 34, "locatedon" should read --located on--.
Column 8, Line 40, "entirely" should read --entirety--.
Column 8, Line 42, "comprises" should read --comprise--.
Column 10, Line 17, in Claim 11, "in raised" should read --in a raised--.

Signed and Sealed this

Thirty-first Day of March, 1998

Bruce Lehman

*Attest:*

BRUCE LEHMAN

*Attesting Officer*

*Commissioner of Patents and Trademarks*